US007809293B2

(12) United States Patent
Inukai

(10) Patent No.: US 7,809,293 B2
(45) Date of Patent: Oct. 5, 2010

(54) IMAGE FORMING APPARATUS AND METHOD OF CHECKING FOR DISCONNECTIONS BETWEEN VOLTAGE GENERATING CIRCUITS AND ELECTRODES THEREOF

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 503 days.

(21) Appl. No.: 11/846,125

(22) Filed: Aug. 28, 2007

(65) Prior Publication Data

US 2008/0056740 A1 Mar. 6, 2008

(30) Foreign Application Priority Data

Aug. 30, 2006 (JP) ..... 2006-233770

(51) Int. Cl.
*G03G 15/00* (2006.01)

(52) U.S. Cl. ..... 399/37

(58) Field of Classification Search ..... 399/37, 399/88–89; 323/220, 364, 367, 225, 324, 323/365; 324/525, 500, 522
See application file for complete search history.

(56) References Cited

U.S. PATENT DOCUMENTS

| | | | | |
|---|---|---|---|---|
| 6,900,994 | B2 * | 5/2005 | Asayama | 363/21.01 |
| 7,263,759 | B2 * | 9/2007 | Marino et al. | 29/593 |
| 2007/0071478 | A1 * | 3/2007 | Hong | 399/88 |

FOREIGN PATENT DOCUMENTS

| | | |
|---|---|---|
| JP | 8178989 | 7/1996 |
| JP | 8228477 | 9/1996 |
| JP | 11023635 | 1/1999 |
| JP | 2003345194 | 12/2003 |
| JP | 2004222370 | 8/2004 |

* cited by examiner

*Primary Examiner*—David M Gray
*Assistant Examiner*—Billy J Lactaoen
(74) *Attorney, Agent, or Firm*—Banner & Witcoff, Ltd.

(57) ABSTRACT

A method and apparatus is provided for checking for a disconnection, with respect to an image forming apparatus including electrical loads and voltage generating circuits that generate voltages that are applied to the electrical loads, by determining if the voltage generating circuits and electrodes that are electrically connected to the electrical loads are normally connected.

16 Claims, 6 Drawing Sheets

IMAGE FORMING APPARATUS AND METHOD OF CHECKING FOR DISCONNECTIONS BETWEEN VOLTAGE GENERATING CIRCUITS AND ELECTRODES THEREOF

CROSS REFERENCE TO RELATED APPLICATION

This application claims priority from Japanese Patent Application No. 2006-233770 filed Aug. 30, 2006. The entire content of this priority application is incorporated herein by reference.

TECHNICAL FIELD

This disclosure relates to an image forming apparatus and a method of checking for disconnections thereof.

BACKGROUND

An image forming apparatus comprises as electrical loads, for example, a charging device that charges a photosensitive drum, a developing device that causes developer to adhere to the charged photosensitive drum, and a transferring device that transfers the developer image onto a print medium. Some image forming apparatuses also comprise a cleaning unit that cleans a belt that conveys a print medium. A high voltage (bias voltage) is applied to these electrical loads via a plurality of connection points from a high voltage power supply. Accordingly, if a terminal breaks or is displaced at any connection point, the connection line from the high voltage power supply to each electrical load may be disconnected. In this case, a normal bias voltage may not be applied to the electrical loads and there is a risk that each electrical load will not work normally.

In view of this, a configuration has been adopted in which one detecting means checks the connection with the high voltage power supply provided for each electrical load.

However, according to the above-described configuration, since the checking means is provided for each electrical load, it is not possible to perform the checking efficiently.

SUMMARY

A method according to the present invention is provided for checking for a disconnection which checks, with respect to an image forming apparatus comprising electrical loads and voltage generating circuits that generate voltages that are applied to the electrical loads, whether or not the voltage generating circuits and electrodes that are electrically connected to the electrical loads are normally connected, the method includes:

connecting a first electrode that is configured to be electrically connected to a first electrical load and a second electrode that is configured to be electrically connected to a second electrical load, by at least one of a short circuit and a resistor having an impedance that is lower than the electrical loads;

generating a second voltage in a second voltage generating circuit that corresponds to the second electrical load;

executing feedback control while detecting a first voltage that is generated at a first voltage generating circuit that corresponds to the first electrical load, so that the first voltage moves towards a predetermined target value; and thereafter, checking if there is a normal connection between the first voltage generating circuit and the first electrode and between the second voltage generating circuit and the second electrode based on an electric potential difference between the first voltage and the second voltage when the first and second electrodes are disconnected from the first and second electrical loads.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

One illustrative aspect of the present invention will now be described referring to FIG. 1 to FIG. 6.

1. Overall Configuration of Printer

Figure 1:
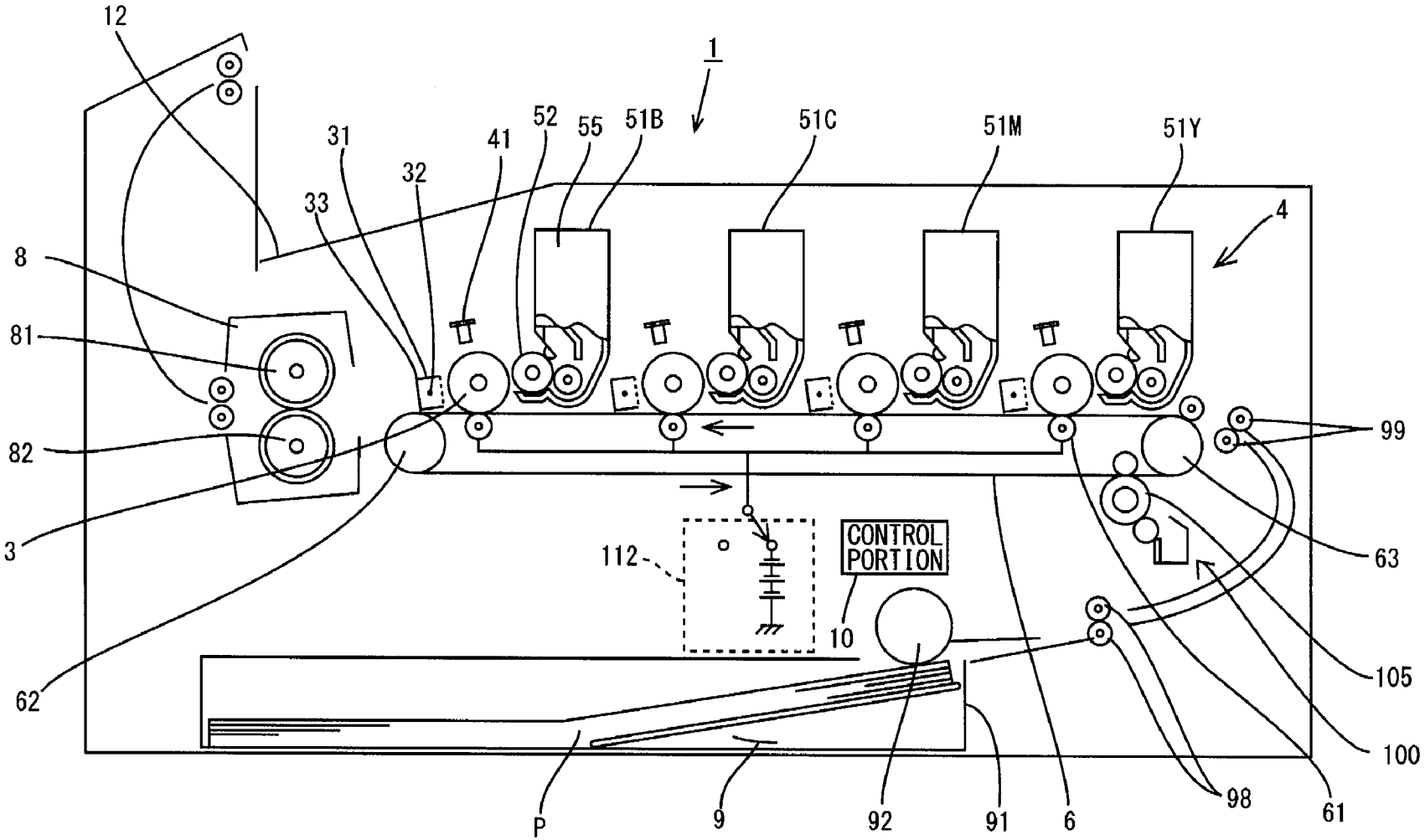
FIG. 1 is a schematic sectional view showing the internal configuration of a printer according to one illustrative aspect of the present invention.

FIG. 1 is a schematic sectional view showing the internal configuration of a color laser printer 1 (hereunder, referred to simply as "printer 1") as the image forming apparatus of the present illustrative aspect. The term "image forming apparatus" refers not only to a printing apparatus such as a printer, but also to a facsimile apparatus or a multifunction apparatus equipped with a printer function and a read function (scanner function) or the like.

The printer 1 shown in FIG. 1 has a toner image forming portion 4, a sheet conveying belt 6 serving as a belt member, a fixing portion 8, a sheet feeding portion 9, a stacker 12, and a control portion 10 and forms an image of colors on a sheet P serving as a print medium in accordance with externally input image data. There term "sheet" herein will broadly refer to any recording medium including, but not limited to, paper, plastic, and the like.

Figure 2:
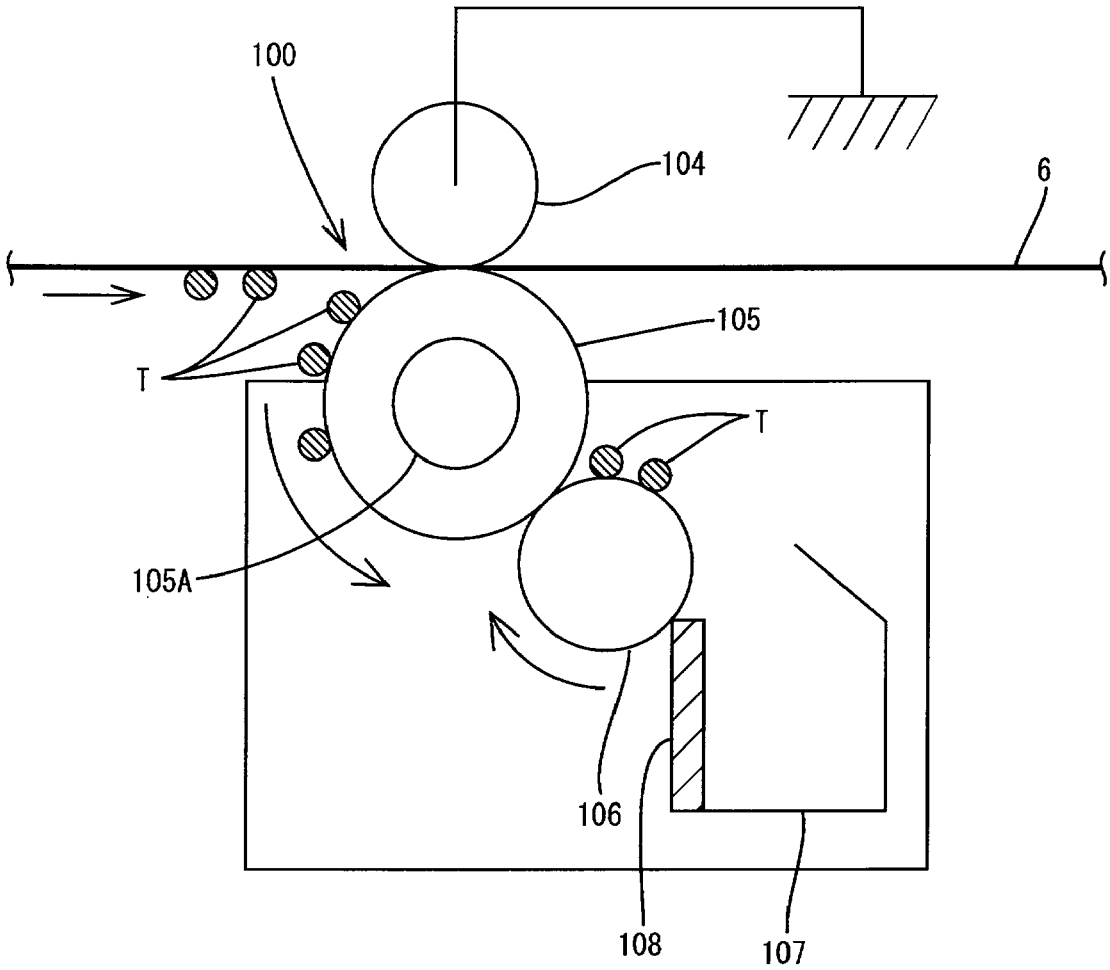
FIG. 2 is an explanatory drawing showing the configuration of a toner removing portion in detail.

The toner image forming portion 4 is provided with four developing units 51Y, 51M, 51C, and 51B, each of which contains toner T (one example of a developer; see FIG. 2). For example, the colors of the toners T can be yellow, magenta, cyan, and black. Each of the developing units 51Y, 51M, 51C, and 51B is provided with a photosensitive drum 3 serving as a photosensitive member, a charging device 31 for uniformly charging the photosensitive drum 3, and a scanner unit 41 serving as exposing means for forming an electrostatic latent image in accordance with image data by irradiating a surface of the photosensitive drum 3 with a laser beam after the charging. Almost all of component parts of the scanner unit 41 are omitted from FIG. 1, and only a component part from which the laser beam is emitted is shown.

Hereinafter, structures of the component parts will be described in detail. In the following description, the relevant character of Y for yellow, M for magenta, C for cyan, and B for black is added to a reference number to distinguish each color.

Each of the photosensitive drums 3 in the toner image forming portion 4 is formed of a member having a substantially cylindrical shape. The photosensitive drums 3 are aligned at substantially constant intervals along a horizontal direction and are disposed in a rotatable condition. The photosensitive drums 3 can include a positively charged photosensitive layer formed on a substrate made from aluminum formed into a substantially cylindrical shape. The aluminum substrate is grounded on a ground line of the printer 1.

The charging device 31 can be a scorotron charging device. The charging device 31 is provided with a charging wire 32 that faces the photosensitive drum 3 and extends in the width direction of the photosensitive drum 3, and a shield case 33 housing the charging wire 32 and having an opening formed on a side thereof facing the photosensitive drum 3. The charging device 31 positively charges the surface of the photosensitive drum 3 (e.g. to +700V) by applying a high voltage to the charging wire 32. The shield case 33 has a structure wherein a grid is provided at the opening that faces the photosensitive drum 3, and the surface of the photosensitive drum 3 is charged to a potential substantially the same as a grid voltage by applying a specified voltage to the grid.

The scanner unit 41 is provided on each of the photosensitive drums 3 at a position downstream from the charging device 31 in a rotation direction of the photosensitive drum 3. The scanner unit 41 emits the laser beam from a light source for one color of the externally input image data to perform laser beam scanning with the use of a mirror surface of a polygon mirror or the like which is rotationally driven by a polygon motor to irradiate the surface of the photosensitive drum 3 with the laser beam.

When the scanner unit 41 irradiates the surface of the photosensitive drum 3 with the laser beam according to the image data, a surface potential of the irradiated part is reduced (to +150 to +200 V) to form an electrostatic latent image on the surface of the photosensitive drum 3.

Each of the developing units 51Y, 51M, 51C, and 51B has a structure wherein a developing unit case 55 housing the toner T of the respective color is provided with a developing roller 52 serving as a developing means, and the developing roller 52 is disposed at a position downstream from the scanner unit 41 with respect to the rotation direction of the photosensitive drum 3 in such a fashion as to contact the photosensitive drum 3. Each of the developing units 51 positively charges the toner T to supply the toner T as a uniform thin layer to the photosensitive drum 3 and causes the positively charged electrostatic latent image (formed on the photosensitive drum 3) to carry the positively charged toner T at the contact portion between the developing roller 52 and the photosensitive drum 3 by the reverse development method, thereby developing the electrostatic latent image.

The developing roller 52 can be made from a base material such as an electroconductive silicone rubber and have a cylindrical shape. A coating layer made from a resin containing fluorine or a rubber material is formed on a surface of the developing roller 52. The toner T housed in the developing unit case 55 is a positively charged nonmagnetic one-component toner. Toner T of various colors (e.g. yellow, magenta, cyan, and black) is housed in the developing unit 51Y, the developing unit 51M, the developing unit 51C, and the developing unit 51B, respectively.

A sheet feeding portion 9 is disposed at a lowermost part of the apparatus and provided with a housing tray 91 for housing sheets P and a pickup roller 92 for feeding the sheets P. The sheets P housed in the housing tray 91 are fed, one by one, from the sheet feeding portion 9 by the pickup roller 92 to be sent to the belt 6 via conveying rollers 98 and registration rollers 99.

The belt 6 has a width which is narrower than that of the photosensitive drum 3 and is carries sheet P on the top surface thereof. The belt 6 is stretched between a driving roller 62 and a driven roller 63. Transfer rollers 61 are positioned opposite each of the photosensitive drums 3, thereby contacting the belt 6. The belt 6 sequentially conveys the sheets P sent from the registration rollers 99 such that the surface on the side thereof opposed to each of the photosensitive drums 3 moves in a direction from the right side to the left side of the drawing as shown in FIG. 1 by rotation of the driving roller 62, thereby conveying the sheets P to the fixing portion 8.

A cleaning roller 105 (one example of "first electrical load" or "first cleaning roller") serving as removing means is disposed at a position close to the driven roller 63 on the side of the belt 6 that is turned around by the driving roller 62.

FIG. 2 is an explanatory drawing that illustrates a structure of the toner removing portion 100 provided with the cleaning roller 105 in detail. As shown in FIG. 2, the cleaning roller 105 has a shaft member 105A extending in a width direction of the belt 6, and can include a foamed material comprising silicone surrounding the shaft member 105A. The cleaning roller 105 is provided in such a fashion that it rotates while being in contact with the belt 6 when a predetermined first bias voltage V1 is applied between the cleaning roller 105 and a metallic electrode roller 104 (one example of "pressure roller") that is disposed at a position opposed to the cleaning roller 105 across the belt 6. With this first bias voltage V1, toner T (one example of "adhered substance") that is deposited on the belt 6 is removed by the cleaning roller 105. For instance, when the electrode roller 104 is grounded by being connected to the ground line (one example of "predetermined potential") and a bias (e.g. −1200 V) having a polarity opposite to that of the toner T is applied to the cleaning roller 105, the toner T is attracted by the cleaning roller 105 and can be removed. The cleaning roller 105 is driven by driving means (not shown) such that a portion of the cleaning roller 105 that contacts the belt 6 is driven in a direction opposite to a direction in which the belt 6 is turned.

The cleaning roller 105 is provided with a collection roller 106 (one example of "second electrical load" or "second cleaning roller") made from a metal (for example, a nickeled iron material or a stainless material) that removes the toner T that adheres to the cleaning roller 105, and a retention box (retention container) 107 that retains the toner T that is removed from the cleaning roller 105. A cleaning blade 108, which can be made from a rubber, contacts against the collection roller 106 and removes the toner T adhered to the collection roller 106.

Referring back to FIG. 1, the transfer roller 61 transfers a toner image that is formed on the photosensitive drum 3 onto the sheet P that is conveyed by the belt 6 when a transfer bias (e.g. −10 to −15 μA) which has a polarity that is opposite to the charged polarity of the toner T is applied between the transfer roller 61 and the photosensitive drum 3 by a power source 112 of a negative voltage.

The fixing portion 8 is provided with a heat roller 81 and a pressure roller 82. The heat roller 81 and the pressure roller 82 convey sheet P and ensure the toner image is fixed on the sheet P by heating and pressurizing.

The stacker 12 is formed on a top face of the printer 1. The stacker 12 is disposed at the discharge side of the fixing portion 8 to retain the sheets P that are discharged from the fixing portion 8. The control portion 10 comprises a control apparatus, or the like, that uses an unshown CPU and controls the overall operations of the printer 1.

2. Configuration of High Voltage Control Apparatus

Figure 3:
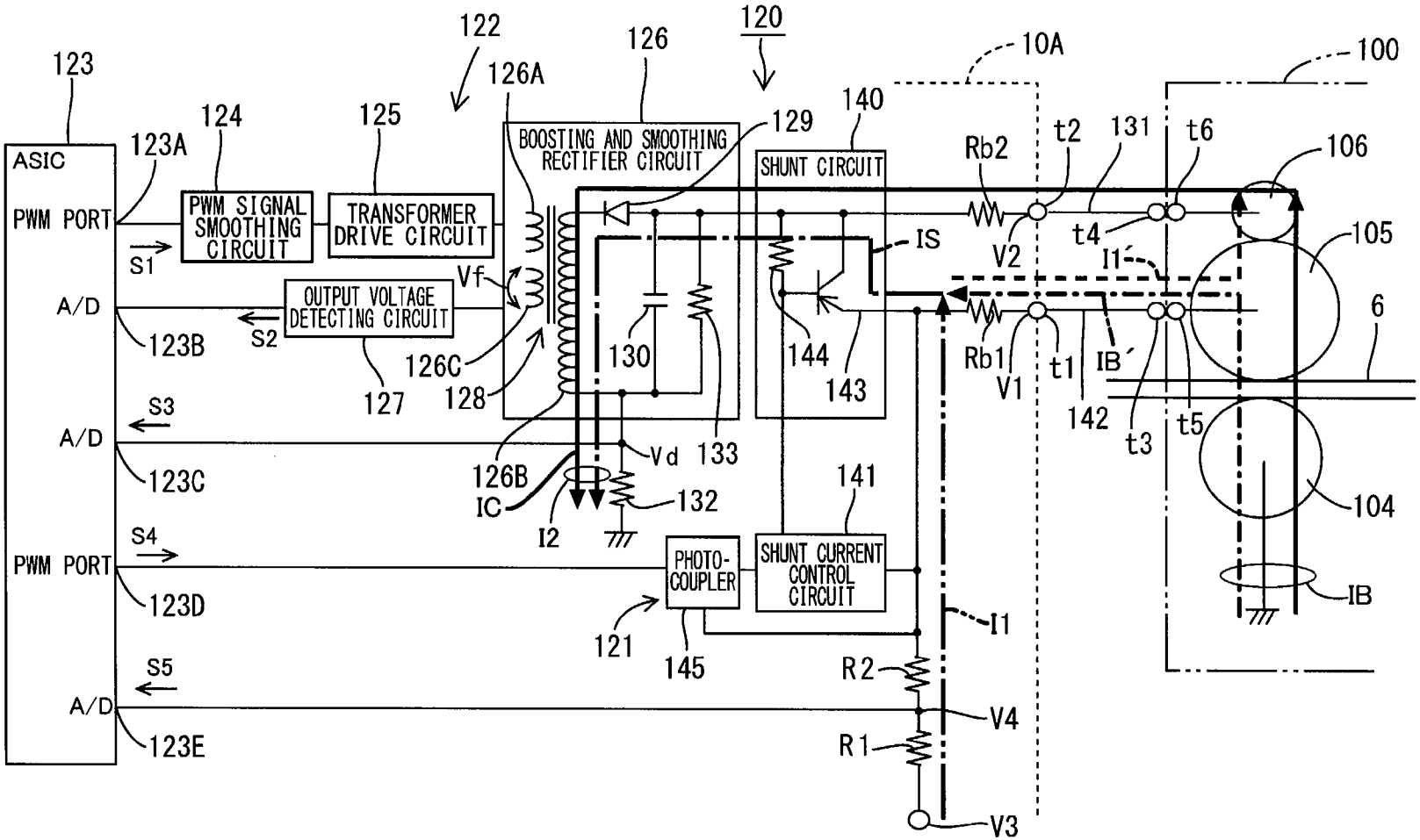
FIG. 3 is a block diagram of component parts that generate a bias voltage for the toner removing portion.

On a control board 10A of the aforementioned control portion 10 is mounted a high voltage control apparatus 120 that generates bias voltages that are respectively applied to each electrical load provided in the printer 1, such as the transfer rollers 61, the developing rollers 52, the charging device 31, and the toner removing portion 100. FIG. 3 illustrates component parts that generate a bias voltage (first bias voltage V1, second bias voltage V2) for the toner removing portion 100 among these electrical loads.

More specifically, on the control board 10A are provided a first bias generating circuit 121 (one example of "first voltage generating circuit"), a second bias generating circuit 122 (one example of "second voltage generating circuit"), and a PWM (Pulse Width Modulation) control circuit 123 consisting of, for example, an application specific integrated circuit (ASIC).

(1) Second Bias Generating Circuit

The second bias generating circuit 122 generates a second bias voltage V2 (one example of "second voltage"; for example, a target value of −1600V) that is applied to the collection roller 106, and includes a PWM signal smoothing circuit 124, a transformer drive circuit 125, a boosting and smoothing rectifier circuit 126, and an output voltage detecting circuit 127. Among these circuits, the PWM signal smoothing circuit 124 receives and smoothes a PWM signal S1 from a PWM port 123A of the PWM control circuit 123, and sends this smoothed PWM signal S1 to the transformer drive circuit 125. The transformer drive circuit 125 is configured to feed an oscillating current to a primary-side winding 126A of the boosting and smoothing rectifier circuit 126 based on the PWM signal S1 that is received.

The boosting and smoothing rectifier circuit 126 includes a transformer 128, a diode 129, and a smoothing capacitor 130. The transformer 128 has a secondary-side winding 126B, the primary-side winding 126A, and an auxiliary winding 126C. One end of the secondary-side winding 126B is connected to a connection line 131 that is connected to a roller shaft of the collection roller 106 via the diode 129 and a second output terminal t2. Further, the smoothing capacitor 130 and a discharge resistor 133 are connected to the secondary-side winding 126B in parallel. The second output terminal t2 and the connection line 131 are connected via a separable connector.

With this configuration, the boosting and smoothing rectifier circuit 126 boosts and rectifies the oscillating voltage in the primary-side winding 126A and applies the resulting voltage as the second bias voltage V2 to the roller shaft of the collection roller 106.

The output voltage detecting circuit 127 is connected to the PWM control circuit 123 and the auxiliary winding 126C of the transformer 128 in the boosting and smoothing rectifier circuit 126. The output voltage detecting circuit 127 detects an output voltage Vf generated between the two ends of the auxiliary winding 126C and inputs that detection signal S2 into an A/D port 123B of the PWM control circuit 123. Since the output voltage Vf is proportionately related to the second bias voltage V2 that is the output voltage of the secondary-side winding 126B, the PWM control circuit 123 executes constant voltage control for making the second bias voltage V2 into a target value (for example, −1600V) by appropriately changing a duty ratio of the PWM signal S1 so that this output voltage Vf becomes a predetermined constant value.

(2) First Bias Generating Circuit

The first bias generating circuit 121 generates the first bias voltage V1 (one example of "first voltage"; for example, a target value of −1200V) that is applied to the cleaning roller 105. In the present illustrative aspect, the first bias generating circuit 121 generates the first bias voltage V1 that can be applied to the cleaning roller 105 based on the aforementioned second bias voltage V2 that is generated by the second bias generating circuit 122. More specifically, the first bias generating circuit 121 principally comprises a shunt circuit 140 and a shunt current control circuit 141. The shunt circuit 140 includes a first output terminal t1 that is connected to a connection line 142 that connects to the cleaning roller 105, and a transistor 143 as a current control element that is connected between the shunt circuit 140 and the second output terminal t2. More specifically, in the pnp-type transistor 143, a collector is connected on the second output terminal t2 side, an emitter is connected on the first output terminal t1 side, and a base is connected to the second output terminal t2 side via an input resistor 144. Further, the emitter (first output terminal t1) of the transistor 143 is connected to a predetermined reference potential (for example, positive potential of 3.3v) V3 line (one example of "reference potential line") via feedback resistors R1 and R2. The first output terminal t1 and the connection line 142 are connected via a separable connector.

The shunt current control circuit 141 is connected to a PWM port 123D of the PWM control circuit 123 via a photocoupler 145. The shunt current control circuit 141 regulates the current amount of a shunt current IS that flows to the shunt circuit 140 by controlling the base potential of the transistor 143 in accordance with a PWM signal S4 that is output from the PWM port 123D. In the PWM control circuit 123, a contact potential V4 (one example of "detection voltage") between the feedback resistors R1 and R2 is input to an A/D port 123E as a detection signal S5. Since the contact potential V4 is proportionately related to the first bias voltage V1 as the output voltage of the first bias generating circuit 121, the PWM control circuit 123 executes a constant voltage control so that the first bias voltage V1 is at the target value (for example, −1200V) by appropriately changing the duty ratio of the PWM signal S4 so that the contact potential V4 becomes a predetermined constant value. Accordingly, the feedback resistors R1 and R2 function as a "voltage detecting portion" and the PWM control circuit 123 functions as a "feedback control portion" or "PWM control portion". The photocoupler 145 isolates the current on the PWM control circuit 123 side so that it is not mixed in with a first current I1 to be described later.

3. Method of Monitoring Belt Current Flowing to Sheet Conveying Belt

The impedance of the cleaning roller 105, the belt 6, or a sheet P on the belt 6 that (are resistive members) fluctuates significantly depending on the temperature or humidity of the printer 1, and a belt current IB (one example of "third current") flowing to the belt 6, also can fluctuate. Since there is a risk of damage, such as holes forming, when an overcurrent (for example, 100 μA) that is greater than a fixed current flows to the belt 6, it is necessary to monitor the belt current IB. Further, since the belt 6 or cleaning roller 105 or the like deteriorates depending on the frequency of use, it is important to measure the impedance to ascertain the period for replacement.

However, since the path or direction of the current flowing between the toner removing portion 100 and the high voltage control apparatus 120 changes according to the loading state between the cleaning roller 105 and the belt 6, it is not possible to accurately measure the belt current IB at a predetermined position on the toner removing portion 100 side. More specifically, for example, when a large amount of the toner T is adhered to the belt 6, the impedance between the belt 6 and the cleaning roller 105 grows larger and the voltage drop at that point also becomes large. Since the first bias voltage V1 thus becomes lower than the target value (−1200V), in order to return the first bias voltage V1 to the target value the shunt current control circuit 141 controls the base current of the transistor 143 so as to decrease the shunt current IS and increases the voltage between the collector and the emitter (inter-terminal voltage between first output terminal t1 and second output terminal t2). At this time, a partial current I1' of the first current I1 (flowing via the feedback resistors R1 and R2 from the reference potential V3 line) flows to the collection roller 106 via the first output terminal t1 and the cleaning roller 105.

In contrast, for example, in a case in which there is a high humidity in the printer 1 and the belt 6 is sandwiched with a strong contact force by the cleaning roller 105 and the electrode roller 104, the impedance between the belt 6 and the cleaning roller 105 growing smaller, and the voltage drop at this point also becomes small. Since the first bias voltage V1 thus becomes higher than the target value (−1200V), in order to return the first bias voltage V1 to the target value the shunt current control circuit 141 controls the base current of the transistor 143 so as to increase the shunt current IS and decreases the voltage between the collector and the emitter (inter-terminal voltage between first output terminal t1 and second output terminal t2). At this time, a partial current IB' of the belt current IB flows to the first output terminal t1 side and merges with the first current I1. This is the manner in which the path or direction of the current flowing between the toner removing portion 100 and the high voltage control apparatus 120 changes according to the loading state between the cleaning roller 105 and the belt 6.

Therefore, in the present illustrative aspect, first, a configuration is provided for detecting a second current I2 (=current IC (current flowing to the secondary-side winding 126B via the second output terminal t2 from the collection roller 106)+ shunt current IS) that flows to the secondary-side winding 126B of the boosting and smoothing rectifier circuit 126. More specifically, the other end of the secondary-side winding 126B of the boosting and smoothing rectifier circuit 126 is connected to a ground line via a current measuring resistor 132 (one example of "second resistor"), and a detection signal S3 in accordance with a terminal voltage Vd of the current measuring resistor 132 is input at an A/D port 123C of the PWM control circuit 123. The second current I2 flows to the current measuring resistor 132 and the terminal voltage Vd also changes in accordance with this current value. The PWM control circuit 123 can calculate the second current I2 based on this terminal voltage Vd and a resistance value rd of the current measuring resistor 132.

The PWM control circuit 123 can also calculate the first current I1 based on the above described contact potential V4 that is input at the A/D port 123E, the reference potential V3, and resistance values r1 and r2 of the feedback resistors R1 and R2.

In this case, when the impedance between the belt 6 and the cleaning roller 105 grows small and the current IB' flows to the first output terminal t1 side, the belt current IB can be expressed by the following formula.

$$IC+IB'=(Vd/rd)-I1$$

$$I1=(V3-V1)/(r1+r2)$$

$$IB=IC+IB'=(Vd/rd)-\{(V3-V1)/(r1+r2)\} \quad \text{[Formula 1]}$$

In contrast, when the impedance between the belt 6 and the cleaning roller 105 grows large and the current I1' flows to the collection roller 106 side via the first output terminal t1 and the cleaning roller 105, the belt current IB can be expressed by the following formula.

$$IC=(Vd/rd)-I1$$

$$I1=(V3-V1)/(r1+r2)$$

$$IB=IC=(Vd/rd)-\{(V3-V1)/(r1+r2)\} \quad \text{[Formula 2]}$$

As a result, in Formulas 1 and 2 the formula for calculating the belt current IB is the same. This means that regardless of whether the current IB' or the current I1' flows, the belt current IB can be calculated using the same formula (Formulas 1 and 2). The PWM control circuit 123 reads out information relating to the above described formulas from an unshown memory, and calculates the belt current IB when necessary in accordance with the relevant formula.

As a result of the above described calculation processing, when the PWM control circuit 123 determines, for example, that the belt current IB is greater than or equal to a predetermined value (for example, a current value that is slightly smaller than a level that damages the belt 6), the PWM control circuit 123 switches to a constant current control that makes the belt current IB a constant value that is less than the predetermined value. Further, the PWM control circuit 123 calculates the impedance of the cleaning roller 105 and the belt 6 based on the belt current IB obtained by the calculation processing and the value of the current first bias voltage V1 or the second bias voltage V2, when this value is greater than or equal to a predetermined value, the PWM control circuit 123 determines that it is time to replace the cleaning roller 105 (and the like) and can display a message (and the like) to this effect on an unshown display portion of the printer 1 to notify the user.

4. Method of Checking for Disconnections

As shown in FIG. 3, the first output terminal t1 of the first bias generating circuit 121 is electrically connected to a first electrode t3 that contacts an electrode t5 that is connected to a roller shaft of the cleaning roller 105 via the connection line 142 which links a plurality of contact points. Thus, the first bias voltage V1 of the first bias generating circuit 121 can be applied to the cleaning roller 105. Further, the second output terminal t2 of the second bias generating circuit 122 is electrically connected to a second electrode t4 that contacts an electrode t6 that is connected to a roller shaft of the collection roller 106 via the connection line 131 which links a plurality of contact points. Thus, the second bias voltage V2 of the second bias generating circuit 122 can be applied to the collection roller 106.

On the other hand, for example, if a disconnection occurs at any location in the aforementioned connection lines 131 and 142, or there is a connection failure between the first output terminal t1 and the second output terminal t2 and between the connection lines 131 and 142, or a connection failure or the like occurs between the connection lines 131 and 142 and between the first electrode t3 and the second electrode t4, even if the target voltage is being generated normally at the bias generating circuits 121 and 122, that target voltage is not applied normally to the cleaning roller 105 and the like and thus the cleaning capability declines.

Figure 4:
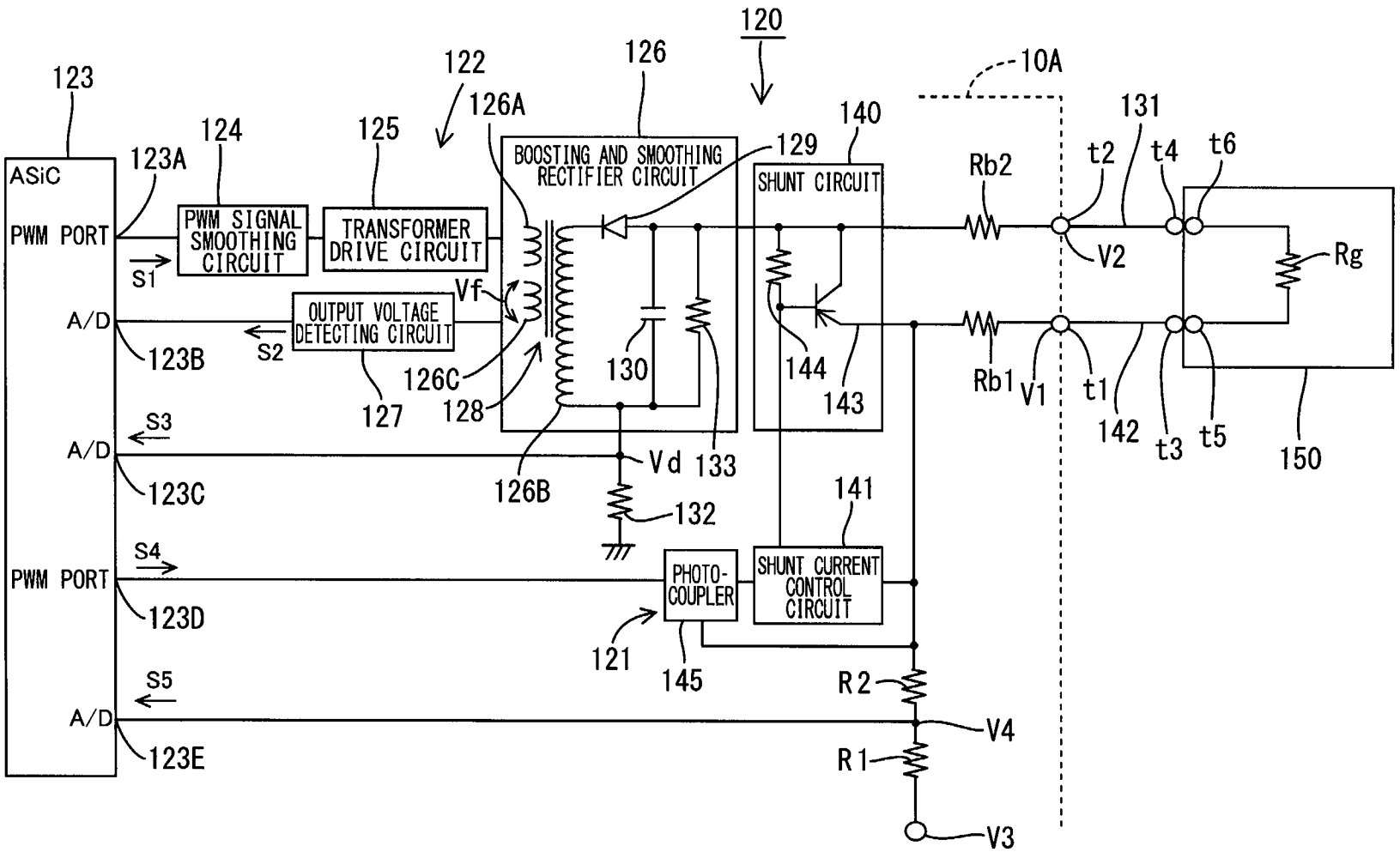
FIG. 4 is a circuit diagram at a time of a disconnection check.

Thus, it is necessary to perform a disconnection check or a connection check with respect to the connection lines 131 and 142. FIG. 4 is a circuit diagram at the time of a disconnection check. In this connection, a current limiting resistor Rb1 (e.g., having a resistance value on the order of megaΩ) for suppressing an overcurrent is connected between the emitter of the transistor 143 and the first output terminal t1, and a current limiting resistor Rb2 (e.g., having a resistance value on the order of megaΩ) for suppressing an overcurrent is also connected between the collector of the transistor 143 and the second output terminal t2. For example, when a user or a checking person removes the toner removing portion 100 that is provided as part of the unit, the first electrode t3 and the second electrode t4 that had been electrically connected to the cleaning roller 105 and the collection roller 106 are exposed inside the case of the printer 1. Thereafter, a connection member 150 is provided as shown in FIG. 4 instead of the toner removing portion 100. Thereby, the first electrode t3 and the second electrode t4 are electrically connected in a condition in which they sandwich a low impedance resistor Rg (having an impedance that is extremely low compared to the impedance of the cleaning roller 105 and the collection roller 106) that is provided in the connection member 150.

Figure 5:
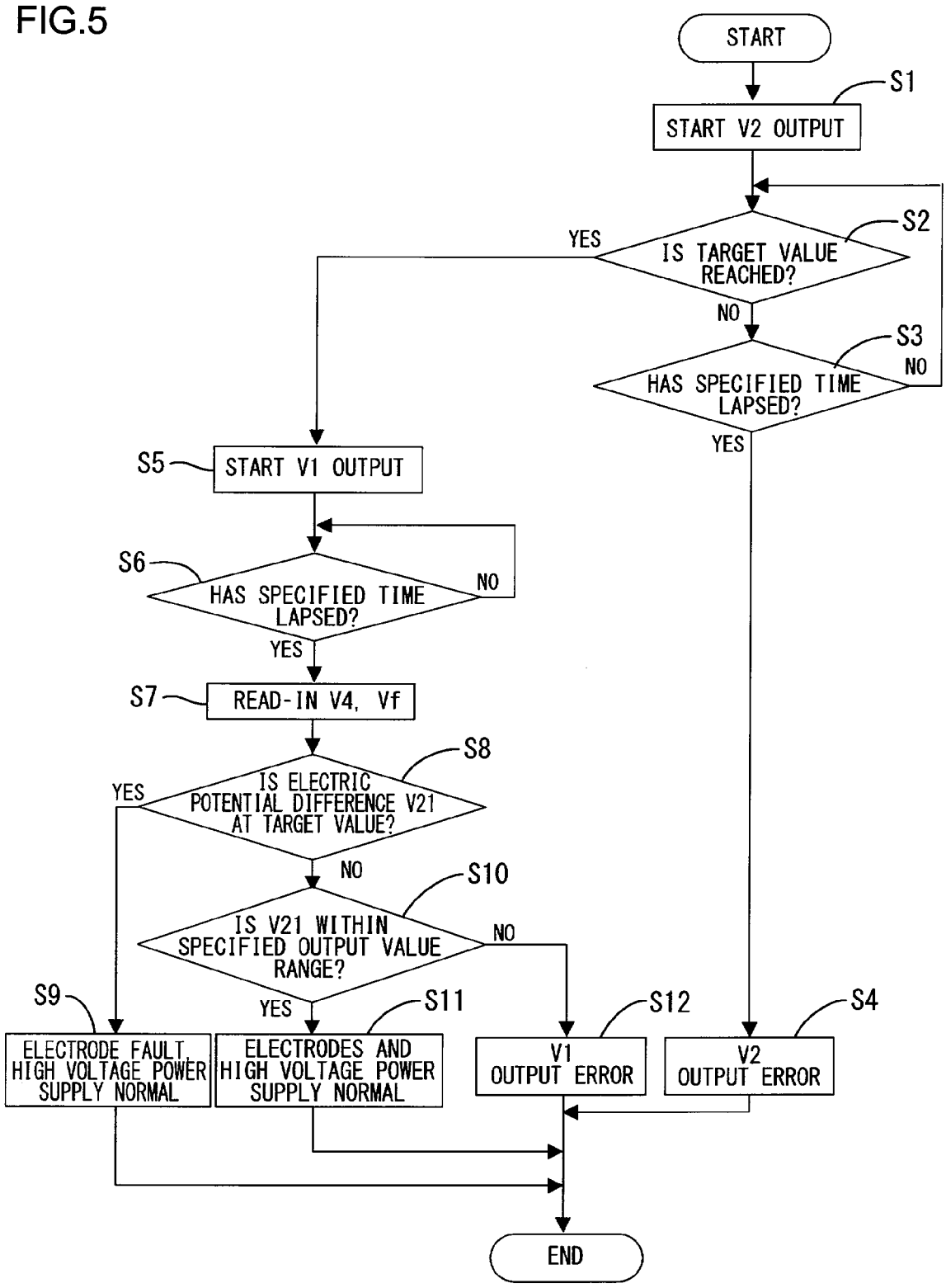
FIG. 5 is a flowchart illustrating the procedure of the checking process.

In this state, when the user or the like perform a predetermined operation on an unshown console of the printer 1, the PWM control circuit 123 executes the check flow shown in FIG. 5. First, at S1, the PWM control circuit 123 activates the second bias generating circuit 122 and increases the duty ratio (PWM value) of the PWM signal S1 from the PWM port 123A (in the present illustrative aspect, a configuration is adopted whereby the output voltage of each bias generating circuit increases as the duty ratio increases). At S2, the PWM control circuit 123 determines whether or not the second bias voltage V2 has reached the target value (−1600V) based on a detection signal S2 (output voltage Vf) that is input to the A/D port 123B. In this case, when the second bias voltage V2 does not reach the target value within a specified time (S2: N and S3: Y), it means that originally the second bias generating circuit 122 could not normally generate the second bias voltage V2. Hence, at S4, the PWM control circuit 123 executes error processing that, for example, displays a second bias voltage output error on an unshown display portion of the printer 1 and records the error in an unshown internal memory of the printer 1.

In contrast, when the second bias voltage V2 does reach the target value within the specified time (S2: Y), at S5, the PWM control circuit 123 activates the first bias generating circuit 121 and increases the duty ratio (PWM value) of the PWM signal S4 from the PWM port 123D (in this illustrative aspect, a configuration is adopted in which the output voltage of each bias generating circuit increases as the duty ratio increases). More specifically, the first bias voltage V1 can be calculated with the following formula.

$$V1=(V3-V2)*(Rb2+Rg+Rb1)/(Rg2+Rg+Rb1+r1+r2) \quad \text{[Formula 3]}$$

Thus, the PWM control circuit 123 increase the PWM value such that the first bias voltage V1 increases in the direction of the target value (−1200V). Accompanying this, the transistor 143 of the shunt circuit 140 shifts to the OFF side that restricts the shunt current IS. Subsequently, after the lapse of a specified time that is sufficient to allow the first bias voltage V1 to reach the aforementioned target value at the start of normal operations of the printer 1 at S6 (S6: Y), at S7 the PWM control circuit 123 incorporates the detection signal S5 (contact potential V4) that is input at the A/D port 123E and the detection signal S2 (output voltage Vf) that is input at the A/D port 123B, and determines at S8 whether or not an electric potential difference V21 (=V2−V1) between the first bias voltage V1 and the second bias voltage V2 reached the target value (in this illustrative aspect, 400V).

Figure 6:
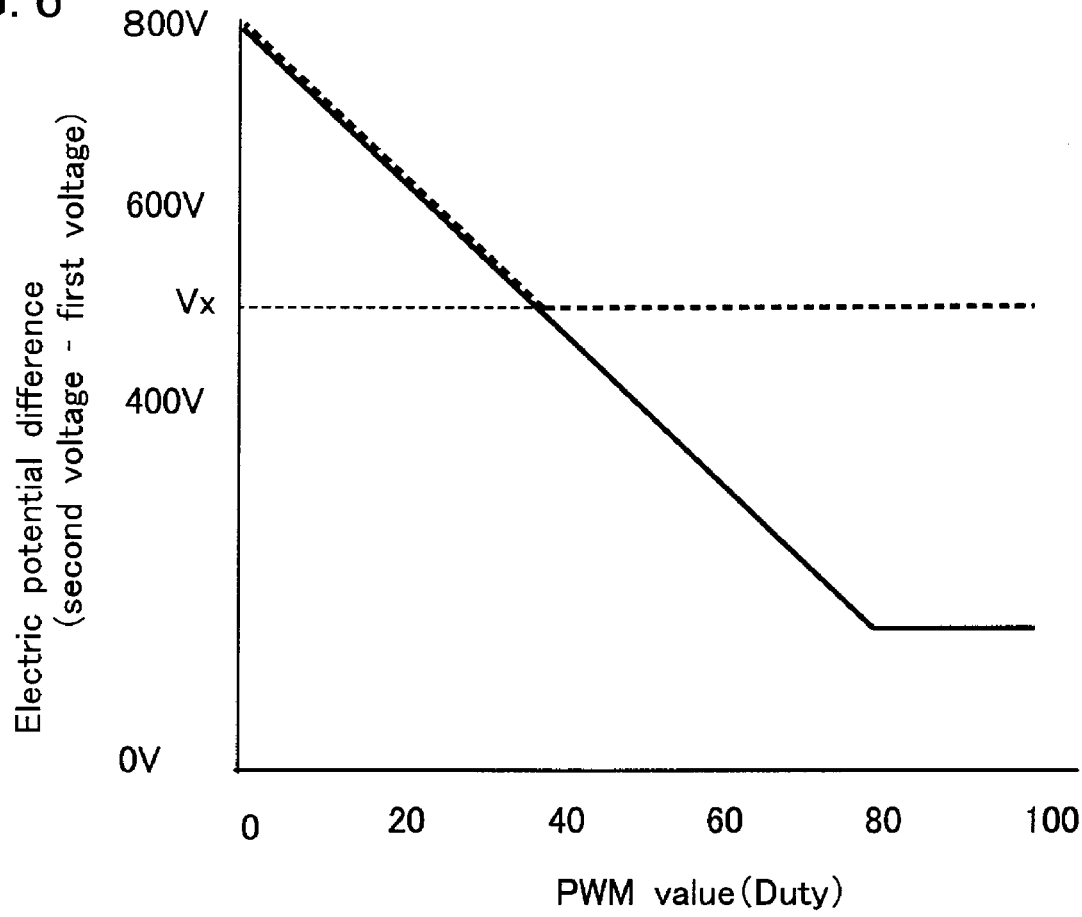
FIG. 6 is a graph showing the relation between electric potential differences and PWM values.

In this case, when a disconnection or connection failure occurs at any place in the connection lines 131 and 142 or the two output terminals t1 and t2, as shown in FIG. 6, the bias generating circuits 121 and 122 can freely output the first bias voltage V1 and the second bias voltage V2 without being subject to any constraints caused by a voltage drop at the aforementioned low impedance resistor Rg. That is, the first bias voltage V1 and the second bias voltage V2 can be made to reach their respective target values in accordance with the increase in the PWM value (see the solid line in the graph of FIG. 6). At this time, in FIG. 5, the result at S8 is "Y", and at S9 error processing is executed that, for example, displays a disconnection error on an unshown display portion of the printer 1 and records the error in an unshown internal memory of the printer 1.

In contrast, when a disconnection or connection failure does not occur at any place in the connection lines 131 and 142, the first bias voltage V1 and the second bias voltage V2 are subject to a constraint caused by a voltage drop at the low impedance resistor Rg. As a result, the duty ratio of the PWM signal S4 is increased, and even if the transistor 143 enters a substantially OFF state, the aforementioned electric potential difference V21 may still be unable to reach the target value (see the dotted line in the graph of FIG. 6). At this time, the electric potential difference V21 is a value Vx that is obtained by the above described Formula 3. When the electric potential difference V21 has not reached the target value and is within a predetermined specified output value range that is based on the aforementioned voltage Vx (S8: N and S10: Y), the state is a normal state in which neither a disconnection error nor a bias voltage output error has occurred, and the PWM control circuit 123, for example, displays that result on an unshown display portion of the printer 1 and records the result in an unshown internal memory of the printer 1 (S11).

When the electric potential difference V21 has not reached the target value and is outside a predetermined specified output value range that is based on the aforementioned voltage Vx (S8: N and S10: N), it means that the first bias generating circuit 121 has not originally been able to generate the first bias voltage V1 normally. Therefore, at S12, the PWM control circuit 123 executes error processing that, for example, displays a first bias voltage output error on an unshown display portion of the printer 1 and records the error in an unshown internal memory of the printer 1. Thus, the PWM control circuit 123 functions as a "checking portion".

According to the present illustrative aspect, by connecting the first electrode t3 and the second electrode t4 at the low impedance resistor Rg to monitor the electric potential difference V21 between the first bias voltage V1 and the second bias voltage V2, a check for a disconnection or a connection failure in the two connection lines 131 and 142 that link the first electrode t3 and the second electrode t4, respectively, can be performed at one time. Furthermore, since the aforementioned electric potential difference V21 can be calculated on the basis of the output voltage Vf and the contact potential V4 that can be detected on the control board 10A side, it is not necessary to provide a structure for monitoring voltage or current on the toner removing portion 100 side. Accordingly, additional wiring is unnecessary and effects caused by noise can be suppressed to the maximum degree.

A program for causing the PWM control circuit 123 to execute the processing shown in FIG. 5 is previously stored inside the high voltage control apparatus 120, and that processing can be executed by performing a predetermined operation. Accordingly, after shipment of the printer 1, as long as the above described connection member 150 is available, a check for a disconnection or a connection failure can be performed at the installation location of the printer 1.

<Other Illustrative Aspects>

The present invention is not limited to the illustrative aspects described by the foregoing descriptions and drawings. For example, the following illustrative aspects are also included in the technical scope of the present invention.

(1) Although in the above described illustrative aspect a configuration is adopted in which only the second bias generating circuit 122 has the transformer 128, a configuration may also be adopted in which a transformer is also provided in the first bias generating circuit 121 to generate a bias voltage independently from the second bias generating circuit 122.

(2) Although according to the above described illustrative aspect an example was described in which the first bias voltage V1 and the second bias voltage V2 have negative polarities, they may be positive polarities. In this case, the current directions will be the reverse of those in the above described illustrative aspect.

(3) In addition to the above described belt 6, for example, an intermediate transfer belt may be employed as a belt.

(4) In addition to the toner T, the adhered substance may be paper powder or the like.

(5) Although the cleaning roller 105 and the collection roller 106 and the like are described above as electrical loads, an electrical load is not limited thereto and may be another electrical load such as the charging device 31, the developing roller 52, or the transfer roller 61, as long as a plurality of electrical loads are electrically connected to each other.

(6) Although in the above described illustrative aspect a configuration is adopted in which a program for executing the processing shown in FIG. 5 is stored inside the high voltage control apparatus 120, a configuration may also be adopted in which the program is stored in an external device (for example, a personal computer) that is connected to the printer 1 in a manner enabling data communication, and in which the external device operates in accordance with the program to perform a disconnection check while incorporating the output voltage Vf and the contact potential V4 and the like from the printer 1.

(7) Although in the above described illustrative aspect a configuration is adopted which connects the low impedance resistor Rg when performing a disconnection check, the configuration may also be one that causes a short circuit between the first electrode t3 and the second electrode t4.

(8) Although according to the above described illustrative aspect a configuration is adopted in which a disconnection check is performed on the basis of the electric potential difference V21, the present invention is not limited thereto, and a configuration may be adopted in which a disconnection check is performed on the basis of the duty ratio (PWM value) of the PWM signal S4 that is applied to the first bias generating circuit 121. More specifically, as shown in FIG. 6, when there is no disconnection (e.g. because of the constraint received by a voltage drop at the low impedance resistor Rg), the PWM value quickly increases as far as a predetermined value (for example, 95% or more) that causes the transistor 143 to turn off. Accordingly, a disconnection check can be performed on the basis of whether or not the PWM value is greater than or equal to the relevant predetermined value.

(9) Further, as long as the image forming apparatus is one having the above described belt, the present invention is not limited to a tandem (single-path) system that comprises an image bearing member for each developing unit, and may be a four-cycle (single-drum) system in which each developing unit carries out development with respect to a common image bearing member. Furthermore, the apparatus according to the present invention may employ either a direct transfer system that directly transfers a developer image onto a medium for recording or an intermediate transfer system that indirectly transfers a developer image onto a medium for recording via an intermediate transfer belt.

What is claimed is:

1. A method of checking continuity between a voltage generating circuit and an electrical load in an image forming apparatus comprising first and second electrodes, first and second voltage generating circuits, and first and second electrical loads, wherein the first voltage generating circuit and the first electrical load are electrically connected to the first electrode, and the second voltage generating circuit and the second electrical load are electrically connected to the second electrode, comprising:

disconnecting the first electrical load from the first electrode;

disconnecting the second electrical load from the second electrode;

connecting a resistor having an impedance that is lower than the first and second electrical loads between the first electrode and the second electrode;

generating a first voltage by the first voltage generating circuit for the first electrical load;

generating a second voltage by the second voltage generating circuit for the second electrical load;

detecting a voltage generated by the first voltage generating circuit;

executing feedback control to bring the first voltage to a predetermined target value based on the detected voltage; and checking the continuity between the first voltage generating circuit and the first electrode and between the second voltage generating circuit and the second electrode based on a difference between the first voltage and the second voltage.

2. A method of checking continuity between a voltage generating circuit and an electrical load in an image forming apparatus comprising first and second electrodes, first and second voltage generating circuits, and first and second electrical loads, wherein the first voltage generating circuit and the first electrical load are electrically connected to the first electrode, and the second voltage generating circuit and the second electrical load are electrically connected to the second electrode, comprising:

disconnecting the first electrical load from the first electrode;

disconnecting the second electrical load from the second electrode;

connecting a resistor having an impedance that is lower than the first and second electrical loads between the first electrode and the second electrode;

generating a first voltage by the first voltage generating circuit for the first electrical load;

generating a second voltage by the second voltage generating circuit for the second electrical load;

generating a second voltage in a second voltage generating circuit that corresponds to the second electrical load;

detecting a voltage generated by the first voltage generating circuit;

executing PWM control to bring the first voltage to a predetermined target value based on the detected voltage; and checking continuity between the first voltage generating circuit and the first electrode and between the second voltage generating circuit and the second electrode based on a PWM value in the PWM control.

3. An image forming apparatus, comprising:

a first electrical load and a second electrical load that are electrically connected to each other;

a first voltage generating circuit configured to generate a first voltage that is applied to the first electrical load;

a second voltage generating circuit configured to generate a second voltage that is applied to the second electrical load;

a voltage detecting portion configured to detect the first voltage of the first voltage generating circuit;

a feedback control portion configured to execute feedback control to bring the detected first voltage to a predetermined target value; and a checking portion configured to check continuity between the first voltage generating circuit and the first electrode and between the second voltage generating circuit and the second electrode on the basis of a difference between the first voltage and the second voltage measured in a condition that a resistor having a lower impedance than the first and second electrical loads is connected between a first electrode that is configured to be electrically connected to the first electrical load and a second electrode that is configured to be electrically connected to the second electrical load.

4. The image forming apparatus according to claim 3, wherein the second voltage generating circuit includes a transformer.

5. The image forming apparatus according to claim 4, wherein the first voltage generating circuit is connected between the first electrode and the second electrode and includes a shunt circuit configured to feed a current between a predetermined reference potential line and a secondary-side winding of the transformer, wherein the generated voltage is controlled by controlling a current that flows to the shunt circuit.

6. The image forming apparatus according to claim 3, further comprising a belt;

wherein the first electrical load is a first cleaning roller configured to come in contact with the belt and electrically attract an adhered substance on the belt.

7. The image forming apparatus according to claim 6, wherein the second electrical load is a second cleaning roller configured to electrically attract the adhered substance from the first cleaning roller.

8. The image forming apparatus according to claim 7, further comprising a pressure roller, wherein the belt is positioned between and in contact with the pressure roller and the first cleaning roller.

9. The image forming apparatus according to claim 8, wherein the pressure roller is grounded to a predetermined potential.

10. An image forming apparatus, comprising:

a first electrical load and a second electrical load that are electrically connected to each other;

a first voltage generating circuit configured to generate a first voltage that is applied to the first electrical load;

a second voltage generating circuit configured to generate a second voltage that is applied to the second electrical load;

a voltage detecting portion configured to detect the first voltage of the first voltage generating circuit;

a PWM control portion configured to execute PWM control to bring the detected first voltage to a predetermined target value; and a checking portion configured to check continuity between the first voltage generating circuit and the first electrode and between the second voltage generating circuit and the second electrode on the basis of a difference between the first voltage and the second voltage measured in a condition that a resistor having a lower impedance than the first and second electrical loads is connected between a first electrode that is configured to be electrically connected to the first electrical load and a second electrode that is configured to be electrically connected to the second electrical load.

11. The image forming apparatus according to claim 10, wherein the second voltage generating circuit includes a transformer.

12. The image forming apparatus according to claim 11, wherein the first voltage generating circuit is connected between the first electrode and the second electrode and includes a shunt circuit configured to feed a current between a predetermined reference potential line and a secondary-side winding of the transformer, wherein the generated voltage is controlled by controlling a current that flows to the shunt circuit.

13. The image forming apparatus according to claim 10, further comprising a belt;

wherein the first electrical load is a first cleaning roller configured to come in contact with the belt and electrically attract an adhered substance on the belt.

14. The image forming apparatus according to claim 13, wherein the second electrical load is a second cleaning roller configured to electrically attract the adhered substance from the first cleaning roller.

15. The image forming apparatus according to claim 14, further comprising a pressure roller, wherein the belt is configured to be positioned between and in contact with the pressure roller and the first cleaning roller.

16. The image forming apparatus according to claim 15, wherein the pressure roller is grounded to a predetermined potential.

* * * * *